US005298055A

United States Patent [19]

Semel et al.

[11] Patent Number: 5,298,055

[45] Date of Patent: Mar. 29, 1994

[54] IRON-BASED POWDER MIXTURES CONTAINING BINDER-LUBRICANT

[75] Inventors: Frederick J. Semel, Riverton, N.J.; Sydney Luk, Lafayette Hill, Pa.

[73] Assignee: Hoeganaes Corporation, Riverton, N.J.

[21] Appl. No.: 848,264

[22] Filed: Mar. 9, 1992

[51] Int. Cl.[5] ..... B22F 1/00

[52] U.S. Cl. ..... 75/252; 75/231

[58] Field of Search ..... 75/252, 254, 231; 106/403, 404

[56] References Cited

U.S. PATENT DOCUMENTS

| | | | |
|---|---|---|---|
| 3,307,924 | 3/1967 | Michael | 29/182.5 |
| 3,470,019 | 9/1969 | Steele | 117/227 |
| 3,516,933 | 6/1970 | Andrews et al. | 252/12 |
| 3,846,126 | 11/1974 | Foley et al. | 75/228 |
| 3,988,524 | 10/1976 | Dreyer et al. | 428/403 |
| 4,062,678 | 12/1977 | Dreyer et al. | 75/228 |
| 4,075,384 | 2/1978 | Suzuki et al. | 427/127 |
| 4,106,932 | 8/1978 | Blachford | 75/252 |
| 4,116,906 | 9/1978 | Ishino et al. | 106/308 M |
| 4,181,525 | 1/1980 | Novinski | 75/525 |
| 4,268,599 | 5/1981 | Russell | 106/308 M |
| 4,483,905 | 11/1984 | Engström | 428/570 |
| 4,491,559 | 1/1985 | Grab et al. | 419/36 |
| 4,502,982 | 3/1985 | Horie et al. | 524/440 |
| 4,504,441 | 3/1985 | Kuyper | 419/36 |
| 4,545,926 | 10/1985 | Fouts et al. | 252/511 |
| 4,634,627 | 1/1987 | Fujiki et al. | 428/900 |
| 4,676,831 | 6/1987 | Engström | 75/252 |
| 4,721,599 | 1/1988 | Nakamura | 419/29 |
| 4,834,800 | 5/1989 | Semel | 106/403 |
| 4,921,665 | 5/1990 | Klar et al. | 419/23 |
| 4,946,499 | 8/1990 | Sakuranda | 75/343 |
| 4,976,778 | 12/1990 | Berry et al. | 75/254 |

FOREIGN PATENT DOCUMENTS

| | | |
|---|---|---|
| 45-127751 | 12/1970 | Japan . |
| 435474 | 10/1967 | Switzerland . |
| 2149714 | 6/1985 | United Kingdom . |
| 2228744A | 9/1990 | United Kingdom . |

OTHER PUBLICATIONS

Chemical Abstracts, vol. 102, No. 2, Jan. 14, 1985, Columbus, Ohio, USA Nissan Motor Co., Ltd., "Materials for Injection Molding," p. 292, column 1, abstract-No. 11 329q & Jpn. Kokai Tokkyo Koho JP 59,121,150 (84, 121,150).

Chemical Abstracts, vol. 100, No. 20, May 14, 1984, Columbus, Ohio, USA, Nissan Motor Co. Ltd., "Injection Molding Materials," p. 272, column 2, abstract-No. 160 951x & Jpn. Kokai Tokkyo Koho JP 58,223,662 (83, 223,662).

Chemical Abstracts, vol. 114, No. 18, May 6, 1991, Columbus, Ohio, USA, Takayama T. et al., "Sintering for Precision Structural Parts From Steel," p. 283, column 2, abstract-No. 168 865g & Jpn. Kokai Tokkyo Koho JP 02,141,502 (90,141,502).

"Pressing the Hard to Press Powders", C. T. Waldo, IBM Corporation, Jul. 1983.

"Binders for Briquetting and Agglomeration", Henry C. Messman, Proceedings of the 15th Biennial Conference, pp. 173-178; Aug. 1977.

"Agglomeration: Growing Larger in Applications and Technology", Jon E. Browning, Chemical Engineering, Dec. 4, 1967, pp. 147-170.

"Influence on Precision of PM Parts of Various Binder Additions to Powder", J. Tengzelius and U. Engström, Powder Metallurgy, 1985, vol. 28, No. 1, pp. 43-48.

"Properties of Parts Made From a Binder Treated 0.45% Phosphorus Containing Iron Powder Blend", F. J. Semel et al., Progress in Powder Metallurgy, 1987, vol. 43, p. 723.

"Statistical Process Control in Iron Powder Production and New Product Development", F. J. Semel et al., SAE Technical Paper No. 880114, International Congress & Exposition, 1988.

"Properties of Parts Made from ANCORBOND® Processed Carbon Steel Powder Mix (F-0008)", F. J. Semel, Modern Developments in Powder Metallurgy, 1988, vol. 21, p. 101.

*Primary Examiner*—George Wyszomierski

*Attorney, Agent, or Firm*—Woodcock Washburn Kurtz Mackiewicz & Norris

[57] ABSTRACT

An improved metallurgical powder composition comprising an iron-based powder and an alloying powder is provided. The composition contains a polyalkylene oxide having a number average molecular weight of at least about 7,000 as a binder. The binder of this invention permits the bonded powder composition to achieve compressibility equivalent to that of unbonded compositions and maintains resistance to dusting and segregation of the alloying powder.

14 Claims, No Drawings

IRON-BASED POWDER MIXTURES CONTAINING BINDER-LUBRICANT

BACKGROUND OF THE INVENTION

The present invention relates to homogeneous iron-based powder mixtures of the kind containing iron or steel powders and at least one alloying powder. More particularly, the invention relates to such mixtures that contain a binder of high molecular weight polyalkylene oxide that not only provides resistance to segregation and/or dusting of the alloying powder but also provides lubricity during compaction, increasing the powder compressibility without increasing die ejection forces.

The use of powder metallurgical techniques in the production of metal parts is well established. In such manufacturing, iron or steel powders are often mixed with at least one other alloying element, also in particulate form, followed by compaction and sintering. The presence of the alloying element permits the attainment of strength and other mechanical properties in the sintered part at levels which could not be reached with unalloyed iron or steel powders alone.

The alloying ingredients that are normally used in iron-based powder mixtures, however, typically differ from the base iron or steel powders in particle size, shape, and density. For example, the average particle size of the iron-based powders normally used in the manufacture of sintered metal parts is typically about 70–100 microns. In contrast, the average particle size of most alloying ingredients used in conjunction with the iron-based powders is less than about 20 microns, most often less than 15 microns, and in some cases under 5 microns. Alloying powders are purposely used in such a finely-divided state to promote rapid homogenization of the alloy ingredients by solid-state diffusion during the sintering operation. This extremely fine size, together with the overall differences between the iron-based and alloying powders in particle size, shape, and density, make these powder mixtures susceptible to the undesirable separatory phenomena of segregation and dusting.

In general, powder compositions are prepared by dry-blending the iron-based powder and the alloying powder. Initially, a reasonably uniform blend is attained, but upon subsequent handling of the mixture, the difference in morphology between the two powder components immediately causes the two different powders to begin to separate. The dynamics of handling the powder mixture during storage and transfer cause the smaller alloying powder particles to migrate through the interstices of the iron-based powder matrix. The normal forces of gravity, particularly where the alloying powder is denser than the iron powder, cause the alloying powder to migrate downwardly toward the bottom of the mixture's container, resulting in a loss of homogeneity of the mixture (segregation). On the other hand, air currents which can develop within the powder matrix as a result of handling can cause the smaller alloying powders, particularly if they are less dense than the iron powders, to migrate upwardly. If these buoyant forces are high enough, some of the alloying particles can, in the phenomenon known as dusting, escape the mixture entirely, resulting in a decrease in the concentration of the alloy element.

Various organic binders have been used to bind or "glue" the finer alloying powder to the coarser iron-based particles to prevent segregation and dusting. For example, U.S. Pat. No. 4,483,905 to Engstrum teaches the use of a binding agent that is broadly described as being of "a sticky or fat character" in an amount up to about 1% by weight of the powder composition. U.S. Pat. No. 4,676,831 to Engstrum discloses the use of certain tall oils as binding agents. Also, U.S. Pat. No. 4,834,800 to Semel discloses the use of certain film-forming polymeric resins that are insoluble or substantially insoluble in water as binding agents. These binders are effective in preventing segregation and dusting, but like any of the other organic binders used by the prior art, they can adversely affect the compressibility of the powder even when present in only small amounts.

The "compressibility" of a powder blend is a measure of its performance under various conditions of compaction. In the art of powder metallurgy, a powder composition is generally compacted under great pressure in a die, and the compacted "green" part is then removed from the die and sintered. It is recognized in this art that the density (and usually the strength) of this green part vary directly with the compaction pressure. In terms of "compressibility", one powder composition is said to be more compressible than another if, at a given compaction pressure, it can be pressed to a higher green density, or alternatively, if it requires less compaction pressure to attain a specified green density.

It has been found that, although the green density generally increases with the compaction pressure, the relationship is not linear; the rate of density increase levels off significantly above compaction pressures of about 30–40 tsi as the attainable density thereafter begins to approach its theoretical maximum asymptotically. Moreover, the precise degree of change in the density-pressure curve varies with the powder composition. This "leveling-off" phenomenon is more pronounced in binder-containing powder compositions of the prior art, for example, than in their unbonded counterpart compositions. Therefore, although the bonded compositions are generally more compressible than their unbonded counterparts at compaction pressures below about 30 tsi, they are less compressible at higher compaction pressures, above about 40 tsi. Depending on the particular composition, the "cross-over" point at which the bonded and unbonded compositions exhibit equivalent compressibility occurs at a compaction pressure in the range of about 30–40 tsi. Because retaining high green density is important in most powder metallurgical applications, such a decrease in compressibility at the higher compaction pressures, which usually provide the best density characteristics, can be a significant disadvantage.

Metal powder compositions are also generally provided with a lubricant, such as a metal stearate or synthetic wax, in order to facilitate ejection of the compacted component from the die. The friction forces that must be overcome in order to remove a compacted part from the die, which generally increase with the pressure used to compact the part, are measured as the "stripping" and "sliding" pressures. The lubricants reduce these pressures, but the presence of the lubricants also adversely affects compressibility. Although the compressibility of bonded powder compositions can be increased by reducing the amount of lubricant used, the resulting decrease in lubricity can cause unacceptably large increases in the ejection forces, which can result in scoring of the die, loss of die life, and imperfections in the surface of the compacted part.

Accordingly, there remains a need for a binder that permits the bonded powder composition to achieve compressibility equivalent to that of unbonded compositions, that preferably permits the reduction in the amount of lubricant content by the amount of the binder incorporated into the composition, and that at the same time maintains resistance to dusting and segregation.

SUMMARY OF THE INVENTION

The present invention provides an improved metallurgical powder composition comprising an iron-based powder, a minor amount of at least one alloying powder, and an organic binder for the iron-based and alloying powders, where the composition is characterized in that at least 40% by weight of said binder is a polyalkylene oxide of the general formula $$HO-(CH_2\overset{\overset{R}{|}}{C}H-O)_n-H$$

where R is H, $C_3$, or $C_2H_5$, and n is the average number of repeating oxyalkylene units sufficient to provide a number average molecular weight of at least about 7,000. In preferred embodiments, at least 50% by weight, more preferably at least 75% by weight, of the organic binder is the high molecular weight polyalkylene oxide of the invention. In those cases where the polyalkylene oxide constitutes less than 100% of the organic binder, the balance of that binder can be any of the other suitable organic materials used as binders in metallurgical compositions in the past. Preferred polyalkylene oxide binders have an average molecular weight in the range of 15,000–100,000. In specific embodiments, the binder consists essentially of a polyethylene oxide having an average molecular weight of about 15,000–35,000.

The bonded compositions of the present invention do not decrease in compressibility relative to their unbonded analogs at high compaction pressures. More particularly, it has been found that metallurgical powder compositions containing the high molecular weight polyalkylene oxide binders of the present invention exhibit the same or better compressibility as the identical powder composition but without any organic binder at compaction pressures up to about 50 tsi (700 MPa). It has also been found that with many of the bonded compositions of the present invention, the ejection forces decrease with increasing compaction pressure, up to compaction pressures of about 700 MPa. This is also contrary to the normal expectation that ejection forces will increase with an increase in compaction pressure.

DETAILED DESCRIPTION OF THE INVENTION

According to the present invention, it has been found that the compaction performance of binder-containing metallurgical powder compositions can be improved, while maintaining resistance to segregation and dusting, when at least part of the binder is a high molecular weight polyalkylene oxide. More particularly, the bonded metallurgical powder compositions of the invention exhibit overall improvements in compressibility and ejection forces for compactions up to at least 50 tsi (700 MPa) as compared to binder-containing powder compositions of the prior art.

The binding agents of the invention are polyalkylene oxides of the general formula $$HO-(CH_2\overset{\overset{R}{|}}{C}H-O)_n-H$$

where R is H, $CH_3$, or $C_2H_5$; and n is the average number of repeating oxyalkylene units providing a number average molecular weight of at least about 7,000. The alkylene oxide polymers are prepared by condensation of the monomeric alkylene oxide (or the corresponding monomeric glycol) by well known techniques. Preferably the polyalkylene oxide has a number average molecular weight of at least 15,000. In one preferred embodiment, the binder used in the composition is at least about 75% by weight, and preferably at least about 85% by weight, of a polyalkylene oxide having an average molecular weight of about 15,000–35,000. In other preferred embodiments, the binder used in the composition is a blend of a polyalkylene oxide of average molecular weight of at least 75,000, preferably at least about 100,000, with up to about 40% by weight (based on total binder weight) of a polyglycol of average molecular weight below about 7000.

Suitable polyalkylene oxides of the formula shown above are commercially available. For example, CARBOWAX PEG polyethylene glycols of appropriate molecular weights from Union Carbide Corporation can be used. Examples of such products are CARBOWAX PEG 8000 (average molecular weight about 7,000–9,000) and CARBOWAX PEG 20M (average molecular weight approximately 17,500). Molecular weights can, in general, be calculated according to the procedure disclosed in the Union Carbide publication "CARBOWAX Polyethylene Glycols" (1986). Higher molecular weight (100,000 and above) polyethylene oxides are also available from Union Carbide under its POLYOX line of resins, WSR series. A particularly preferred such resin is WSR-N10, having an average molecular weight of about 100,000. Suitable polyethylene glycols are also available from Dow Chemical Company as part of its E-series of products, an example of which is Dow's E8000 polyethylene glycol having an average molecular weight of about 8,000. Another preferred product is Polyethylene Glycol 35000, which has a number average molecular weight of about 35000, available from Fluka Chemie AG.

The polyalkylene oxides of the invention are preferably in the form of homopolymers. However, they can take the form of copolymers of two or more of the monomeric alkylene oxides or glycols described above, such as, for example, a copolymer of ethylene glycol and propylene glycol. The polyalkylene oxides of the invention can also be in the form of copolymers of such $C_2$–$C_4$ glycols (or the corresponding oxides) with other copolymerizable monomers, such as glycidylethers. An example of such a copolymer is "Parel 58" from Zeon Chemicals, Inc., a copolymer of propyleneglycol and an allylglycidylether having an average molecular weight of about 100,000–1,000,000. In the case of any copolymer of the above-described $C_2$–$C_4$ alkylene oxides or glycols with another copolymerizable monomer, it is preferred that at least 50% by weight of the contributing monomers, more preferably at least 60% by weight of the contributing monomers, be the $C_2$–$C_4$ alkylene oxides or glycols.

The metallurgical powder compositions of this invention can include other organic binders in addition to the high molecular weight polyalkylene oxide polymers described above, but the polyalkylene oxide polymers should constitute at least 40% by weight, preferably at least 50% by weight, and more preferably at least 75% by weight, of the total binder content of the metallurgical powder compositions of the invention.

Other binders that can be present are any of the polymers or other materials heretofore known for this purpose. Such binders include, for example, the "sticky or fat character" binding agents disclosed in U.S. Pat. No. 4,483,905; the tall oils disclosed in U.S. Pat. No. 4,676,831; or any of the water-insoluble film-forming resins disclosed in U.S. Pat. No. 4,834,800. The disclosures of these patents are incorporated herein by reference. Most preferred from among these additionallyusable binding agents are the methacrylate polymers or copolymers and the vinyl acetate polymers or copolymers disclosed in U.S. Pat. No. 4,834,800.

Other binders that can be used are low molecular weight (that is, below about 7000) polymers or copolymers of ethylene glycol and/or propylene glycol. An example of a preferred low molecular weight polyglycol is Dow Chemical Co.'s Polyglycol 15-200, which is a copolymer having a number average molecular weight of about 2500-2800. These low molecular weight polymers function essentially as plasticizers for the higher-weight components of the binder, and as such are preferably used only when the polyalkylene oxide of the invention as incorporated into the binder has a molecular weight of at least about 15,000, preferably at least about 20,000. Other materials that have been found to fill this plasticizing role in the binder are diesters of phthalic acid, such as dicyclohexyl phthalate, dibutyl phthalate, and di-2-ethylhexyl phthalate.

In a most preferred embodiment for use in the invention, a polyalkylene oxide or mixture of polyalkylene oxides having an average molecular weight of about 15,000-35,000 constitutes all or substantially all of the binder content present in the powder composition. In another highly preferred embodiment, the binder will consist essentially of about 60-95% by weight of a polyalkylene oxide of this invention having an average molecular weight of at least 75,000, and about 5-40% by weight of a plasticizer. An example of such a binder system is a blend of about 70% polyethylene oxide of average molecular weight about 100,000 (e.g. POLYOX WSR-N10 polymer) and about 30% polypropylene glycol copolymer of average molecular weight below about 3,000 (e.g. Dow PolyGlycol 15-200).

The iron-based particles used in the powder compositions of the invention are any of the iron or iron-containing (including steel) particles that can be admixed with particles of other alloying materials for use in standard powder metallurgical methods. Examples of iron-based particles are particles of pure or substantially pure iron; particles of iron pre-alloyed with other elements (for example, steel-producing elements); and particles of iron to which such other elements have been diffusionbonded. The particles of iron-based material useful in this invention can have a weight average particle size up to about 500 microns, but generally the particles will have weight average particle size in the range of about 10-350 microns. Preferred are particles having a maximum average particles size of about 150 microns, and more preferred are particles having an average particle size in the range of about 70-100 microns.

The preferred iron-based particles for use in the invention are highly compressible powders of substantially pure iron; that is, iron containing not more than about 1.0% by weight, preferably no more than about 0.5% by weight, of normal impurities. Examples of such metallurgical-grade pure iron powders are the ANCORSTEEL 1000 series of iron powders (e.g. 1000, 1000B, and 1000C) available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85-3.00 g/cm$^3$, typically 2.94 g/cm$^3$. Other iron powders that can be used in the invention are typical sponge iron powders, such as Hoeganaes' ANCOR MH-100 powder.

An example of a pre-alloyed iron-based powder is iron pre-alloyed with molybdenum (Mo), a preferred version of which can be produced by atomizing a melt of substantially pure iron containing from about 0.5 to about 2.5 weight percent Mo. Such a powder is commercially available as Hoeganaes ANCORSTEEL 85HP steel powder, which contains 0.85 weight percent Mo, less than about 0.4 weight percent, in total, of such other materials as manganese, chromium, silicon, copper, nickel, or aluminum, and less than about 0.02 weight percent carbon. Other commercially available pre-alloyed iron-based powders include Hoeganaes, ANCORSTEEL 150HP, 2000, and 4600V atomized steel powders.

The diffusion-bonded iron-based particles are particles of substantially pure iron that have a layer or coating of one or more other metals, such as steel-producing elements, diffused into their outer surfaces. One such commercially available powder is DISTALOY 4600A diffusion bonded powder from Hoeganaes Corporation, which contains 1.8% nickel, 0.55% molybdenum, and 1.6% copper.

The alloying materials that are admixed with iron-based particles of the kind described above are those known in the metallurgical arts to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferroalloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum.

The alloying materials are used in the composition in the form of particles that are generally of finer size than the particles of iron-based material with which they are admixed. The alloying-material particles generally have a weight average particle size below about 100 microns, preferably below about 75 microns, more preferably below about 30 microns, and most preferably in the range of about 5-20 microns. The amount of alloying material present in the composition will depend on the properties desired of the final sintered part. Generally the amount will be minor, up to about 5% by weight of the total powder weight, although as much as 10–15% by weight can be present for certain specialized powders. A preferred range suitable for most applications is about 0.25–4.0% by weight.

The amount of binder component that will be present in the metallurgical powder composition of the invention depends on such factors as the density and particle size distribution of the alloying powder and the relative weight of the alloying powder in the composition. An additional aspect of the binders of the present invention, however, is that they bond alloying particles of size greater than about 20 microns more efficiently (that is, with less loss in compressibility) than binding agents of the prior art. Although those binding agents were capable of bonding larger particle sizes, the additional amount of material necessary to do so generally caused a reduction in compressibility. The advantage of the polyalkylene oxides of the present invention is that they do not cause a similar decrease in compressibility.

Generally, the polyalkylene oxide-containing binder of this invention will be added to the powder composition in an amount that is about 0.005–1.0% of the combined weights of the iron-based powder and alloying powder. However, a more specific, and preferred, schedule for the addition of binders is according to the following table.

| Density of Alloying Powders ($g/cm^3$) | Weight Ratio of Binder to Alloying Powder According to Particle Size | | |
|---|---|---|---|
| | To ~10 μm | Over 10 to ~20 μm | Over 20 μm |
| ≦2.5 | 0.125 | 0.125–0.175 | ≧0.175 |
| >2.5–4.5 | 0.100 | 0.100–0.125 | ≧0.125 |
| >4.5–7.0 | 0.050 | 0.050–0.075 | 0.075–0.125 |
| >7.0 | 0.025 | 0.025–0.050 | 0.050–0.10 |

Where more than one alloying powder is present, the amount of binder applicable to each such powder is determined from the table, and the total added to the powder composition.

The binder can be incorporated into the powder composition according to the procedure taught by U.S. Pat. No. 4,834,800. Generally, a dry admixture of the iron-based powder and alloying powder is made by conventional techniques. A solution or dispersion of the binder material is then made in an appropriate solvent. The polyalkylene oxides of the invention are generally soluble in water, but are also soluble in certain organic solvents, such as acetone, as well. Moreover, since the binder materials to be added to the powder composition can include materials other than the present polyalkylene oxides, a solvent common to all binder materials must be chosen. The solution or dispersion of binding materials is then mixed with the powders until good wetting of the powders is attained. The wet powder is then spread over a shallow tray and allowed to dry, optionally with the aid of heat or vacuum.

The powder compositions can also contain a lubricant of the kind normally used in powder metallurgical techniques. Generally, the lubricant is mixed directly into the powder composition, usually in an amount up to about 1% by weight, although an alternative manner of providing lubricant to the operation is to apply it to the wall of the die prior to charging the powder composition into the die for compaction. In a preferred embodiment, the lubricant, which is generally a solid in particulate form, is homogeneously admixed into the dry blend of ironbased and alloying powders before that blend is wetted with the solution/dispersion of binder. Preferable lubricants are those that pyrolyze cleanly during sintering. Examples of suitable lubricants are metal stearates such as zinc stearate or any of the synthetic waxes such as ACRAWAX C or PM-100 from Glyco Chemical Company.

In use, a metallurgical powder composition of this invention is compacted in a die at a pressure of about 275–700 MPa (20–50 tsi). Compaction can be performed at ambient conditions, but it will be understood that during plant operation, friction generated during the compaction and ejection processes heats the die tooling so that, in actual practice, the tooling is at somewhat elevated temperatures, generally above about 50° C., and usually in the range of about 55°–95° C. Therefore, in order to simulate actual plant operating conditions, many of the studies on the binders of this invention, as reported in the examples, were conducted at a temperature within that range. It has been found that at such temperatures, the improved binders of this invention provide lubrication to the die during compaction and thereby aid in reducing ejection forces. Because of this self-generated lubricity, the powder compositions of this invention can be used with less traditional lubricant than would otherwise be used. Generally, the level of such lubricant can be reduced by an amount equal to the weight of the binder used in the composition. Because the compressibility of powder mixtures is adversely affected at higher compaction pressures by the presence of unnecessary lubricant, the lubricant reduction enabled by use of the binders of this invention further contributes to the enhanced compressibility of the present powder compositions.

The binder-containing metallurgical powder compositions of this invention exhibit high compressibility even at compaction pressures up to 700 MPa (50 tsi). This distinguishes the present compositions from bonded compositions of the prior art, which generally decrease in compressibility relative to their unbonded analogs at compaction pressures above about 400–550 MPa (30–40 tsi). The bonded compositions of the present invention also enable a reduction in the amount of traditional die lubricant used, without the normally expected increase in ejection forces.

EXAMPLES

In each of the following examples, a mixture of an iron-based powder, an alloying powder, a lubricant, and, except for unbonded control mixes, a binder, was prepared as described below. Two different iron/lubricant blends were first prepared by thoroughly admixing iron powder (Hoeganaes ANCORSTEEL 1000 iron powder) with either 1.0 weight percent or 0.75 weight percent zinc stearate. The pre-lubricated iron powder was then dry-blended with the alloying powder in standard laboratory bottle-mixing equipment for 15–30 minutes, making a series of batches of admixed powder compositions in approximate five-pound amounts. Some of these batches were set aside for use as the unbonded control mixtures that appear in Example 1. Care was taken throughout to avoid any dusting of the alloying powder. Binder-containing mixtures were made by combining the remaining powder mixtures with various binders, as identified in the examples below, in an appropriately-sized bowl of an ordinary food mixer. The binders were added to the powder mixtures in the form of a solution in acetone, which was blended with the powder with a spatula until the mixture had a uniform, wet appearance. Thereafter, the wet powder was spread out on a shallow metal tray and allowed to dry. After drying, the mixture was coaxed through a No. 40 sieve (U.S. series) to break up any large agglomerates that may have formed during drying. A portion of each powder mixture sample so made was set aside for chemical analysis and dusting-resistance determinations. The remainder of the mixture was used to test various properties according to the procedures described below.

The mixtures were tested for dusting resistance by elutriating them with a controlled flow of nitrogen. The test apparatus consisted of a cylindrical glass tube vertically mounted on a two-liter Erlenmeyer flask equipped with a side port to receive the flow of nitrogen. The glass tube (17.5 cm in length, 2.5 cm inside diameter) was equipped with a 400 mesh screen plate positioned about 2.5 cm above the mouth of the flask. A sample of the powder mixture to be tested (20–25 grams) was placed on the screen plate and nitrogen was passed through the tube at the rate of two liters per minute for 15 minutes. At the conclusion of the test, the powder mixture was analyzed to determine the relative amount of alloying powder remaining in the mixture (expressed as a percentage of the before-test concentration of the alloying powder), which is a measure of the composition's resistance to the loss of the alloying powder through dusting and/or segregation.

The apparent density (ASTM B212-76) and flow rate (ASTM B213-77) of the powder composition of each example were also determined. The compositions were pressed into green bars under various conditions as indicated in the examples and the green density (ASTM B331-761) and green strength (ASTM B312-76) were measured. A second set of green bars was pressed to a density of 6.9 g/cm: and then sintered at about 100° to 150° C. in dissociated ammonia for 30 minutes, after which the dimensional change (ASTM B610-76), transverse rupture strength (ASTM B528-76) and sintered density (ASTM B33I-76) were determined.

Three different compaction procedures were employed in preparing the specimens for the determination of green density and green strength. In one procedure, the compositions were compacted to a common density of 6.9 g/cm$^3$ in order to determine the effects of the various binder additions on the compacting pressures required to attain that density. In a second procedure, the compositions were all compacted at a common pressure of 551.1 MPa (40 tsi) in order to determine the effects of differing compositions on green density and green strength and also on the ejection forces, measured as stripping and sliding pressure. Stripping pressure measures the static friction that must be overcome to initiate ejection of the compacted part from the die, calculated as the quotient of the load needed to start ejection over the total cross-sectional area of the part in contact with the die. Sliding pressure, which is a measure of the friction that must be overcome to continue the ejection process, is calculated as the quotient of the average load observed as the part traverses the distance from the point of compaction to the mouth of the die divided by the area of the part in contact with the die. In a third compaction procedure, each of the compositions was compacted at a series of pressures including 413.3, 551.1 and 689.0 MPa (i.e. 30, 40, and 50 tsi) using tools pre-heated to a temperature of approximately 63° C.

Example 1 is included for comparison purposes and shows the properties obtainable with one of the binders disclosed in U.S. Pat. No. 4,834,800. Examples 2–4 illustrate binders of the present invention. In the examples, unless otherwise indicated, all percentages are by weight.

EXAMPLE 1

Five iron-based powder mixtures with alloying and organic additives as indicated in Table 1.1 were prepared and tested in accordance with the foregoing procedures. As indicated in Table 1.1, alloy content in each case was nominally 1% graphite and 2% copper. The graphite was in all cases Lonza-grade KS-6 with an average particle size of 4 microns. Two different grades of copper were used in making the mixes. Mix 1 was made with Alcan grade 8081 with an average Microtrac particle size of 57 microns. The remaining mixes were all made with Greenback grade 240MD with an average particle size of 22 microns. The iron powder of the mixes was in all cases pre-lubricated using Mallinkrodt Flomet Z zinc stearate. Mixes 1 and 2 Were unbonded controls. Mixes 3 through 5 were each bonded using Vinac B5 polyvinyl acetate (PVAc) from Air Products and Chemicals Co.

TABLE 1.1

| Mix | Graphite | | Copper | | Zinc Stearate | | Binder | |
|---|---|---|---|---|---|---|---|---|
| No. | Content | Type | Content | Type | Content | Type | Content | Type |
| 1 | 1% | KS-6 | 2% | 8081 | 1% | Flomet Z | None | — |
| 2 | 1% | KS-6 | 2% | 240MD | 1% | Flomet Z | None | — |
| 3 | 1% | KS-6 | 2% | 240MD | 1% | Flomet Z | 0.175% | PVAc |
| 4 | 1% | KS-6 | 2% | 240MD | 1% | Flomet Z | 0.225% | PVAc |
| 5 | 1% | KS-6 | 2% | 240MD | 0.75% | Flomet Z | 0.225% | PVAc |

Results of the tests associated with these mixes are shown in Tables 1.2 and 1.3. The properties shown in Table 1.2 correspond to compaction of the mixes to a density of 6.9 g/cm$^3$. The data presented in Table 1.3 show the effects on the green properties and ejection forces of the mixes as a result of compaction at various pressures and at ambient and elevated temperatures.

TABLE 1.2

| Property | | Mix No. 1 | 2 | 3 | 4 | 5 |
|---|---|---|---|---|---|---|
| Dusting Resistance | | | | | | |
| Graphite | (%) | 16 | 14 | 93 | 96 | 97 |
| Copper | (%) | 87 | 31 | 82 | 100 | 96 |
| Powder Properties | | | | | | |
| Apparent Density | (g/cm$^3$) | 3.23 | 3.22 | 3.36 | 3.17 | 3.10 |

TABLE 1.2-continued

| Property | | Mix No. 1 | 2 | 3 | 4 | 5 |
|---|---|---|---|---|---|---|
| Hall Flow | (sec/50 g) | No Flow | No Flow | 24.3 | 24.8 | 24.1 |
| Green Properties @ 6.9 g/cm$^3$ | | | | | | |
| Compacting Pressure | (MPa) | 509.9 | 508.5 | 565.0 | 625.6 | 566.4 |
| Dimensional Change vs Die | (%) | 0.22 | 0.23 | 0.26 | 0.27 | 0.27 |
| Sintered Properties @ 6.9 g/cm$^3$ | | | | | | |
| Dimensional Change vs Die | (%) | 0.24 | 0.32 | 0.34 | 0.32 | 0.31 |
| Sintered Density | (g/cm$^3$) | 6.83 | 6.82 | 6.82 | 6.82 | 6.84 |
| Transv. Rupture Stg. | (MPa) | 1207 | 1193 | 1144 | 1130 | 1166 |
| Rockwell Hardness | ($R_b$) | 89 | 88 | 90 | 85 | 86 |
| Sintered Chemistries | | | | | | |
| Carbon | % | 0.94 | 0.93 | 0.95 | 0.91 | 0.93 |
| Copper | % | 2.03 | 2.05 | 2.11 | 2.03 | 2.02 |
| Oxygen | % | 0.051 | 0.053 | 0.044 | 0.050 | 0.050 |

TABLE 1.3

| Compaction Conditions & Properties | | Mix No. 1 | 2 | 3 | 4 | 5 |
|---|---|---|---|---|---|---|
| Pressure @ 551.2 MPa & Tools @ ~21° C. | | | | | | |
| Green Density | (g/cm$^3$) | 6.93 | 6.94 | 6.87 | 6.83 | 6.85 |
| Green Strength | (MPa) | 8.2 | 8.3 | 8.1 | 7.8 | 8.1 |
| Stripping Pressure | (MPa) | 16.6 | 17.0 | 15.9 | 16.2 | 18.1 |
| Sliding Pressure | (MPa) | 12.4 | 11.9 | 11.6 | 12.6 | 13.4 |
| Pressure @ 413.4 MPa & Tools @ 63° C. | | | | | | |
| Green Density | (g/cm$^3$) | 6.78 | 6.78 | 6.76 | 6.73 | 6.73 |
| Green Strength | (MPa) | 8.9 | 6.9 | 13.1 | 13.9 | 14.6 |
| Stripping Pressure | (MPa) | 15.8 | 16.5 | 15.6 | 14.8 | 16.0 |
| Sliding Pressure | (MPa) | 8.7 | 11.7 | 11.1 | 10.5 | 12.1 |
| Pressure @ 551.2 MPa & Tools @ 63° C. | | | | | | |
| Green Density | (g/cm$^3$) | 6.98 | 6.98 | 6.94 | 6.90 | 6.94 |
| Green Strength | (MPa) | 10.2 | 10.2 | 14.2 | 15.6 | 17.0 |
| Stripping Pressure | (MPa) | 19.2 | 17.9 | 17.3 | 16.4 | 18.8 |
| Sliding Pressure | (MPa) | 12.4 | 12.7 | 12.0 | 11.7 | 14.5 |
| Pressure @ 689 MPa & Tools @ 63° C. | | | | | | |
| Green Density | (g/cm$^3$) | 7.06 | 7.06 | 7.01 | 7.00 | 7.05 |
| Green Strength | (MPa) | 10.7 | 10.7 | 14.6 | 16.6 | 17.9 |
| Stripping Pressure | (MPa) | 18.6 | 18.4 | 18.3 | 17.3 | 19.3 |
| Sliding Pressure | (MPa) | 13.6 | 13.4 | 11.9 | 11.3 | 17.5 |

EXAMPLE 2

Six iron-based powder mixtures (Mixtures 6–11) with alloying and organic additives as indicated in Table 2.1 were prepared and tested according to the above-described procedures. With the exception of the particular binders, the mixes of this example used the same ingredients as Mixes 3–5 of Example 1. Mix 6 of this Example represents the prior art. The binder of mixtures 7–11 of this example, representing the present invention, consisted in whole or in part of a high molecular weight polyethylene oxide (glycol). All mixtures contained 0.25% binder; it is to be noted that, relative to the unbonded mixes of Example 1, the lubricant content of Mixes 6–11 was reduced by the amount of the binder addition (0.25%)–from 1.0% to 0.75%.

TABLE 2.1

NOMINAL MIX COMPOSITION: 1% Graphite, 2% Copper 0.75% Zinc Stearate, 0.25% Binder, Balance - Iron Powder

| Mix No. | Binder Composition | | |
|---|---|---|---|
| 6 | 100% | Polyvinyl Acetate (prior art) | (Air Products - "Vinac B15") |
| 7 | 100% | Polyethylene Oxide | (Union Carbide - POLYOX WSR-N10) |
| 8 | 100% | Polyethylene Glycol | (Union Carbide - "Carbowax 20M") |
| 9 | 100% | Polyethylene Glycol | (Union Carbide - "Carbowax 8000") |
| 10 | 70% | Polyethylene Oxide | (Union Carbide - POLYOX WSR-N10) |
| | 30% | Polypropylene Copolymer | (Dow Chemical - "PolyGlycol 15-200") |
| 11 | 85% | Polyethylene Glycol | (Union Carbide - "Carbowax 20M") |
| | 15% | Polypropylene Copolymer | (Dow Chemical - "PolyGlycol 15-200") |

Results of the tests associated with the mixtures of this Example are shown in Tables 2.2 and 2.3 . The green and sintered properties shown in Table 2.2 correspond to compaction of the mixes to a density of 6.9 g/cm$^3$. The data presented in Table 2.3 show variations in green properties and ejection forces as a result of compaction at various pressures and temperatures.

TABLE 2.2

| Property | | Mix No. 6 | 7 | 8 | 9 | 10 | 11 |
|---|---|---|---|---|---|---|---|
| Dusting Resistance | | | | | | | |
| Graphite | (%) | 99 | 98 | 100 | 85 | 100 | 98 |
| Copper | (%) | 94 | 96 | 93 | 87 | 93 | 91 |
| Powder Properties | | | | | | | |
| Apparent Density | (g/cm$^3$) | 3.36 | 3.09 | 3.21 | 3.16 | 3.31 | 3.31 |
| Hall Flow | (sec/50 g) | 20.8 | 24.0 | 23.5 | 25.2 | 22.4 | 22.4 |
| Green Properties @ 6.9 g/cm$^3$ | | | | | | | |
| Compacting Pressure | (MPa) | 566.9 | 526.6 | 529.2 | 512.6 | 5.09.9 | 509.9 |
| Dimensional Change vs Die | (%) | 0.27 | 0.21 | 0.21 | 0.21 | 0.19 | 0.19 |
| Sintered Properties @ 6.9 g/cm$^3$ | | | | | | | |

TABLE 2.2-continued

| Property | | Mix No. 6 | 7 | 8 | 9 | 10 | 11 |
|---|---|---|---|---|---|---|---|
| Dimensional Change vs Die | (%) | 0.36 | 0.35 | 0.36 | 0.34 | 0.34 | 0.36 |
| Sintered Density | (g/cm$^3$) | 6.82 | 6.81 | 6.81 | 6.80 | 6.80 | 6.80 |
| Transv. Rupture Stg. | (MPa) | 1098 | 1065 | 1158 | 1179 | 1171 | 1111 |
| Rockwell Hardness | ($R_b$) | 84 | 83 | 85 | 84 | 86 | 86 |
| Sintered Chemistries | | | | | | | |
| Carbon | % | 0.95 | 0.94 | 0.92 | 0.93 | 0.91 | 0.93 |
| Copper | % | 2.06 | 2.01 | 2.06 | 2.00 | 2.02 | 2.02 |
| Oxygen | % | 0.051 | 0.051 | 0.053 | 0.055 | 0.053 | 0.053 |

Comparison of the mix properties shown in Table 2.2 with those of the bonded prior art mixtures of Example 1 shows that use of the present binders improved compressibility, as indicated by significant reductions in the compacting pressure required to achieve the density of 6.9 g/cm$^3$. The greatest compressibility improvements were in Mixes 10 and 11, which improved in comparison with the prior art bonded mixes as well as the unbonded control mixes of Example 1. Simultaneously, with the exception of the minor decrease in dusting resistance of mixture 9, the data also show that these improvements were obtained with little or not change in any of the other measured properties.

The results of the compaction studies (Table 2.3) show significant improvement in compressibility resulting from the use of the present binders. These studies also show some reduction in the ejection forces, which, although not necessarily large, was nevertheless significant in that it was contrary to the normal expectation that ejection forces would always rise with increased compaction pressure.

TABLE 2.3

| Compaction Conditions & Properties | | Mix No. 6 | 7 | 8 | 9 | 10 | 11 |
|---|---|---|---|---|---|---|---|
| Pressure @ 551.2 MPa & Tools @ ~21° C. | | | | | | | |
| Green Density | (g/cm$^3$) | 6.88 | 6.93 | 6.92 | 6.93 | 6.93 | 6.94 |
| Green Strength | (MPa) | 8.6 | 10.7 | 10.7 | 9.8 | 10.3 | 11.0 |
| Stripping Pressure | (MPa) | 18.1 | 13.2 | 13.5 | 13.7 | 14.0 | 14.1 |
| Sliding Pressure | (MPa) | 11.7 | 8.5 | 8.5 | 8.7 | 8.7 | 9.3 |
| Pressure @ 413.4 MPa & Tools @ 63° C. | | | | | | | |
| Green Density | (g/cm$^3$) | 6.75 | 6.79 | 6.80 | 6.77 | 6.79 | 6.7 |
| Green Strength | (MPa) | 15.1 | 13.6 | 14.2 | 12.6 | 11.2 | 12.1 |
| Stripping Pressure | (MPa) | 16.3 | 16.6 | 14.8 | 14.4 | 16.0 | 15.7 |
| Sliding Pressure | (MPa) | 11.7 | 10.1 | 10.6 | 9.3 | 11.6 | 11.8 |
| Pressure @ 551.2 MPa & Tools @ 63° C. | | | | | | | |
| Green Density | (g/cm$^3$) | 6.95 | 7.01 | 7.02 | 7.01 | 7.02 | 7.02 |
| Green Strength | (MPa) | 17.2 | 15.3 | 16.4 | 15.3 | 13.0 | 14.3 |
| Stripping Pressure | (MPa) | 17.6 | 16.6 | 16.2 | 15.7 | 17.1 | 17.1 |
| Sliding Pressure | (MPa) | 13.3 | 8.9 | 10.1 | 10.1 | 10.7 | 10.5 |
| Pressure @ 689 MPa & Tools @ 63° C. | | | | | | | |
| Green Density | (g/cm$^3$) | 7.05 | 7.09 | 7.11 | 7.09 | 7.11 | 7.10 |
| Green Strength | (MPa) | 17.9 | 15.4 | 15.0 | 13.3 | 12.4 | 12.7 |
| Stripping Pressure | (MPa) | 19.4 | 16.3 | 15.8 | 16.0 | 16.5 | 17.2 |
| Sliding Pressure | (MPa) | 16.3 | 8.6 | 8.9 | 8.4 | 8.8 | 8.2 |

The first set of results in Table 2.3, corresponding to compaction at 551.2 MPa (40 tsi) with tools at ambient temperature, shows essentially the same compressibility improvements as were indicated in the earlier findings in Table 2.2. In this case, the improvements are indicated by increases in attained density at the constant compaction pressure as opposed to the reduced compacting pressure necessary to attain a given density as indicated in Table 2.2. A comparison of Table 2.3 (and specifically Mixes 7–11 of the present invention) with Table 1.3 (specifically, unbonded mixes 1 and 2) illustrates the important increase in compressibility and decrease in ejection for forces at the higher compaction pressures. More specifically, the green densities of each of the mixes containing the binders of the present invention (Mixes 7–11) exceeded those of the unbonded mixes of Example 1 by 0.03–0.04 g/cm$^3$ for compactions at 551 MPa (40 tsi). The achievement of even such an incremental increase in density over the already-high base density of 6.98 g/cm$^3$ of mixes 1 and 2 is significant. The lubricating effect of the binders of the present invention is indicated by the fact that the sliding pressure for mixes containing the binders of the present invention was significantly lower than the sliding pressures of either the unbonded mixes or mixes containing prior art binders. (Compare mixes 7–11 with mixes 1–6 at compactions of 551 MPa.)

The same trend is shown in comparing the compactions performed at the high pressure of 689 MPa (50 tsi). In all cases, the densities of the mixtures of the present invention were substantially higher than those exhibited by either the unbonded or prior art bonded mixtures of Table 1.3. Ejection forces associated with the mixtures of the present invention in comparison with the mixtures of Table 1.3 were also substantially lower, exhibiting reduced stripping pressure as well as reduced sliding pressure at this compaction level. These reductions are particularly significant since the present mixtures contained 25% less zinc stearate, a traditional lubricant, than mixtures 1–4 of Table 1.3.

EXAMPLE 3

The alloying material used in the test mixtures of this example was particulate Fe:P (average particle size 9.3 microns; density 6.89 g/cm$^3$) having a phosphorus content of about 14.6%. The $Fe_3P$ content of the powder mixture was about 3.1%, providing a total phosphorus content of about 0.45% to the powder composition. The lubricant and binder additions to the mixtures are shown in Table 3.1. Mixes 12 and 13 of the example represent the prior art binder polyvinyl acetate. Mixes 14–17 were bonded with blends of polyethylene oxides or polyethylene glycols of the present invention with one or more other binders (and in the case of mix 14, a plasticizer for the binder, dicyclohexyl phthalate.

TABLE 3.1

| Mix No. | Zinc Stearate Content | Binding Agent Content | | Composition |
|---|---|---|---|---|
| 12 | 1% | 0.125% | 100% | Polyvinylacetate, (Air Products ("Vinac - B15") |
| 13 | 0.75% | 0.25% | 100% | Polyvinylacetate (Air |

TABLE 3.1-continued

| Mix No. | Zinc Stearate Content | Binding Agent Content | Binding Agent Composition |
|---|---|---|---|
| | | | Products, "Vinac - B15") |
| 14 | 0.75% | 0.25% | 50% Polyethylene Glycol, MW 35000 (Fluka Chemie AG) |
| | | | 35% n-Butyl/Methyl Methacraylate Copolymer (Dupont Co. "Elvacite 2550") |
| | | | 15% Dicyclohexyl Phthalate |
| 15 | 0.75% | 0.25% | 50% n-Butyl/Methyl Methacrylate Copolymer (Dupont Co. Elvacite "2550") |
| | | | 50% Polyethylene Glycol (Union Carbide "Carbowax 20M") |
| 16 | 0.75% | 0.25% | 50% Poly-n-Butyl Methacrylate (Dupont Co. "Elvacite 2044") |
| | | | 25% Polyethylene Glycol (Union Carbide "Carbowax 8000" |
| | | | 20% Polyethylene Glycol, MW 35000 (Fluka) |
| | | | 5% Polyethyleneoxide (Union Carbide WSR-N10) |
| 17 | 0.75% | 0.25% | 50% Poly-n-Butyl Methacrylate (Dupont Co. "Elvacite 2044") |
| | | | 50% Polyethyleneoxide (Union Carbide WSR-N10) |

Results of the tests associated with the six mixes of the Example are shown in Tables 3.2 and 3.3. The green and sintered properties in Table 3.2 correspond to compaction to a density of 6.9 g/cm$^3$. The effects of varying compaction conditions on the green properties and ejection forces of the six mixes are presented in Table 3.3.

TABLE 3.2

| Property | | Mix No. 12 | 13 | 14 | 15 | 16 | 17 |
|---|---|---|---|---|---|---|---|
| Dusting Resistance | | | | | | | |
| Phosphorus, As Bonded | (%) | 88 | 90 | 92 | 94 | 90 | 97 |
| Phosphorus, Severe Handling | (%) | 77 | 84 | 85 | 88 | 81 | 90 |
| Powder Properties | | | | | | | |
| Apparent Density | (g/cm$^3$) | 3.23 | 2.80 | 2.98 | 2.99 | 2.99 | 3.05 |
| Hall Flow | (sec/50 g) | 23.8 | 25.7 | 26.1 | 24.9 | 24.8 | 24.3 |
| Green Properties @ 6.9 g/cm$^3$ | | | | | | | |
| Compacting Pressure | (MPa) | 534.7 | 548.4 | 529.2 | 526.4 | 529.1 | 526.4 |
| Dimensional Change vs Die | (%) | 0.22 | 0.24 | 0.21 | 0.20 | 0.20 | 0.21 |
| Sintered Properties @ 6.9 g/cm$^3$ | | | | | | | |
| Dimensional Change vs Die | (%) | −0.18 | −0.20 | −0.16 | −0.15 | −0.14 | −0.13 |
| Sintered Density | (g/cm$^3$) | 6.94 | 6.94 | 6.94 | 6.93 | 6.93 | 6.93 |
| Transv. Rupture Stg. | (MPa) | 823 | 819 | 808 | 801 | 807 | 785 |
| Rockwell Hardness | ($R_b$) | 55 | 55 | 55 | 55 | 55 | 55 |
| Sintered Chemistries | | | | | | | |
| Phosphorus | (%) | 0.45 | 0.43 | 0.46 | 0.44 | 0.44 | 0.45 |
| Oxygen | (%) | 0.058 | 0.059 | 0.055 | 0.061 | 0.060 | 0.060 |

The data in Table 3.2 indicate that the present binders of Mixes 14–17 can be used with lower lubricant (zinc stearate) levels without significant adverse effect on compaction behavior. For example, the dusting resistance data show that the mixes made with the new binders are comparable to, or in some cases better than, Mixes 12 and 13 of the prior art. At the same time, the mixes of the new binders indicate improved green properties relative to Mix 13; improvements compared to Mix 12 were only marginal, but since Mix 12 had only half the binder level—and therefore would have been expected to have the best green properties and compressibility—the fact that the present mixtures showed any improvement at all is significant. In addition, the data in the table also show that both the powder properties and sintered properties of the mixes with the present binders, including the very important flow property, were similar to those of the mixes representing the prior art. Accordingly, increases in compressibility and green properties were attainable with the present binders without loss of other properties.

TABLE 3.3

| Compaction Conditions & Properties | | Mix No. 12 | 13 | 14 | 15 | 16 | 17 |
|---|---|---|---|---|---|---|---|
| Pressure @ 551.2 MPa & Tools @ ~21° C. | | | | | | | |
| Green Density | (g/cm$^3$) | 6.90 | 6.87 | 6.91 | 6.89 | 6.89 | 6.89 |
| Green Strength | (MPa) | 10.7 | 10.5 | 13.4 | 11.4 | 12.1 | 12.2 |
| Stripping Pressure | (MPa) | 19.9 | 23.7 | 23.1 | 24.3 | 23.0 | 23.2 |
| Sliding Pressure | (MPa) | 15.6 | 18.0 | 16.7 | 19.2 | 18.1 | 18.1 |
| Pressure @ 551.2 MPa & Tools @ 63° C. | | | | | | | |
| Green Density | (g/cm$^3$) | 6.95 | 6.94 | 6.97 | 6.95 | 6.95 | 6.96 |
| Green Strength | (MPa) | 17.3 | 21.3 | 20.3 | 20.0 | 20.5 | 20.3 |
| Stripping Pressure | (MPa) | 21.9 | 25.4 | 23.0 | 24.0 | 24.0 | 23.9 |
| Sliding Pressure | (MPa) | 18.5 | 19.3 | 18.8 | 19.7 | 19.1 | 19.1 |
| Pressure @ 689 MPa & Tools @ 63° C. | | | | | | | |
| Green Density | (g/cm$^3$) | 7.11 | 7.10 | 7.15 | 7.13 | 7.11 | 7.13 |
| Green Strength | (MPa) | 19.6 | 24.0 | 22.7 | 21.4 | 23.1 | 22.5 |
| Stripping Pressure | (MPa) | 22.9 | 28.6 | 22.7 | 24.2 | 24.1 | 24.5 |
| Sliding Pressure | (MPa) | 18.3 | 24.3 | 18.8 | 20.4 | 20.0 | 19.7 |

The results of the compaction studies as presented in Table 3.3 generally confirm the abovediscussed indications of compressibility improvements for mixes 14–17 containing the present binders. For example, the green density values of the mixes with the new binders were improved relative to the results for Mix 13 and equivalent to or exceeded the results for Mix 12. In the case of the green strength, the effects of the new binders relative to those of the prior art were dependent on the temperature of the compaction tools. At ambient temperature, the mixes of the new binder exhibited higher values than those of the prior art, but at elevated compaction temperatures, the opposite relation was observed. In all cases, however, the green strengths of the present mixtures were higher than those in either of the two preceding Examples. The ejection force results of the mixes of the new binders indicate little or no dependency on either the temperature of the compaction tools or the magnitude of the compacting pressure. For example, all three data sets, representing the different compaction conditions in Table 3.3, show about the same values for the mixes of the new binders. The ejection force results were generally improved compared to Mix 13, which represents the prior art at the same binder content. Although they were often inferior to the results for Mix 12, this was not unexpected since that mixture had a higher level of lubricant. In all events, the improvements exhibited in compressibility outweigh this instance of adverse effect on the ejection force.

EXAMPLE 4

The alloying materials used in the compositions of this example were 1% graphite, 3% nickel, and 1% copper. The graphite and copper additions were of the kind used in Examples 1 and 2 (i.e., Lonza KS-6 and Greenback 240MD, respectively). The nickel ("Inco 123" nickel, International Nickel Company) had an average Microtrac particle size of 1.4 microns. The lubricant and binder additions to the mixes are shown in Table 4.1. The lubricant used was Acrawax C (Glycol Chemical Co.). Apart from control Mix 18 of the prior art, which was bonded entirely with polyvinyl acetate, the new binders of Mixes 19–22 were blends of polymers as indicated in Table 4.1. The mixes used in this example illustrate powder compositions of the invention in which the high molecular weight polyalkylene oxide constitutes about 50-60% of the total binder weight. Mix 22 is another example of a binder that incorporates a low molecular weight plasticizer, "IndoPol" L-14 polybutene having an average molecular weight of about 320. The binder of Mixes 20 and 2.1 contains a fluoroelastomeric material in addition to the polyalkylene oxide materials of this invention. This material is a copolymer of 1,1,2,3,3-hexafluoro-1-propene with 1,1-difluoroethane having an average molecular weight of 35,000 100,000.

Results of the tests performed on the mixes are shown in Tables 4.2 and 4.3. The green and sintered properties in Table 4.2 were based on compaction to a density of 6.9 g/cm$^3$. The effects of varying compaction conditions on the green properties and ejection forces of the mixes are presented in Table 4.2.

The present Example also provides a more direct comparison to the binder technology of the prior art. In Examples 2 and 3, in order to provide a direct comparison of binder effects on properties, the control mix representing the prior art was made with the same lubricant and binder content as used in the mixes with the present binders. However, these particular mixes would not have been made that way in actual practice. Rather the binder content would have been determined in strict accordance with the binder addition schedule of the prior art, as shown in U.S. Pat. No. 4,834,800, from which the prior art binder was taken. Moreover, reduction of the traditional lubricant content by approximately the amount of the binder addition is an adjunct of the current technology, but would not have been part of the practice of the prior art. Accordingly, the control of this example (Mix 18) has been made with reference to the teachings of U.S. Pat. No. 4,834,800 in that (a) the amount of binder has been calculated according to the schedule disclosed in that patent, and (b) the lubricant level (traditionally about 1%) has not been reduced by the amount of binder used.

TABLE 4.1

| Mix No. | Lubricant Content | Binding Agent Content | | Composition |
|---|---|---|---|---|
| 18 | 1% | 0.225% | 100% | Polyvinyl acetate, Air Products ("Vinac - B15") |
| 19 | 0.75% | 0.25% | 50% | n-Butyl/Methyl Methacrayalate Copolymer (Dupont "Elvacite 2550") |
| | | | 50% | Propyleneoxide/allylglycidylether Copolymer, (Zeon "Parel 58") |
| 20 | 0.75% | 0.25% | 50% | Polyethylene Glycol (Union Carbide "Carbowax 20M") |
| | | | 50% | Fluoroelastomer (3M Company, "FC-2211") |
| 21 | 0.75% | 0.25% | 30% | Propyleneoxide/allylglycidylether Copolymer (Zeon "Parel 58") |
| | | | 30% | Polyethylene Glycol (Union Carbide "Carbowax 20M") |
| | | | 40% | Fluoroelastomer (3M Co., "FC-2211") |
| 22 | 0.75% | 0.25% | 47.5% | Polyvinyl acetate (Air Products, "Vinac B-15") |
| | | | 47.5% | Polyethylene Glycol (Union Carbide Carbowax 20M) |
| | | | 5% | Polybutene Polymer (IndoPol, L-14) |

As shown in Table 4.2, the most significant difference provided by the new binder systems of Mixes 19–22 was in compressibility, where the compacting pressure required to reach the target density was reduced by at least 15% for mixes containing the new binders. Although the dusting resistance associated with the new binders was slightly below that of the binder of the prior art, it was in all cases still above the minimum dusting resistance necessary to retain proper alloying and homogeneity, which value has been found to be about 80%.

TABLE 4.2

| Property | | Mix No. 18 | 19 | 20 | 21 | 22 |
|---|---|---|---|---|---|---|
| Dusting Resistance | | | | | | |
| Graphite | (%) | 100 | 99.5 | 97 | 100 | 97 |
| Nickel | (%) | 94 | 83.0 | 85 | 83 | 89 |
| Copper | (%) | 94 | 85.0 | 87 | 81 | 93 |
| Powder Properties | | | | | | |
| Apparent Density | (g/cm$^3$) | 2.92 | 2.96 | 2.99 | 2.90 | 2.99 |
| Hall Flow | (sec/50 g) | 28.2 | 28.7 | 27.4 | 29.0 | 27.6 |
| Green Properties @ 6.9 g/cm$^3$ | | | | | | |
| Compacting Pressure | (MPa) | 617 | 523.6 | 504.3 | 482.3 | 518.1 |
| Dimensional Change vs Die | (%) | 0.23 | 0.19 | 0.18 | 0.16 | 0.19 |

TABLE 4.2-continued

| Property | | Mix No. 18 | 19 | 20 | 21 | 22 |
|---|---|---|---|---|---|---|
| Sintered Properties @ 6.9 g/cm³ | | | | | | |
| Dimensional Change vs Die | (%) | −0.03 | −0.07 | −0.14 | −0.18 | −0.11 |
| Sintered Density | (g/cm³) | 6.88 | 6.87 | 6.91 | 6.89 | 6.89 |
| Transv. Rupture Stg. | (MPa) | 867 | 821 | 991 | 923 | 904 |
| Rockwell Hardness | ($R_b$) | 86 | 89 | 90 | 89 | 88 |
| Sintered Chemistries | | | | | | |
| Carbon | % | 0.94 | 0.96 | 0.98 | 1.01 | 0.96 |
| Nickel | % | 2.99 | 3.04 | 2.98 | 3.03 | 3.07 |
| Copper | % | 1.02 | 1.06 | 1.05 | 1.06 | 1.07 |
| Oxygen | % | 0.047 | 0.060 | 0.060 | 0.068 | 0.064 |

TABLE 4.3

| Compaction Conditions & Properties | | Mix No. 18 | 19 | 20 | 21 | 22 |
|---|---|---|---|---|---|---|
| Pressure @ 551.2 MPa & Tools @ ~21° C. | | | | | | |
| Green Density | (g/cm³) | 6.82 | 6.90 | 6.94 | 6.96 | 6.90 |
| Green Strength | (MPa) | 10.6 | 10.5 | 10.3 | 11.3 | 10.1 |
| Stripping Pressure | (MPa) | 11.5 | 13.5 | 13.6 | 13.5 | 14.1 |
| Sliding Pressure | (MPa) | 7.5 | 8.0 | 8.4 | 8.3 | 8.8 |
| Pressure @ 413.4 MPA & Tools @ 63° C. | | | | | | |
| Green Density | (g/cm³) | 6.72 | 6.78 | 6.79 | 6.82 | 6.78 |
| Green Strength | (MPa) | 16.0 | 13.8 | 12.0 | 12.8 | 14.5 |
| Stripping Pressure | (MPa) | 14.4 | 15.8 | 14.9 | 15.4 | 15.0 |
| Sliding Pressure | (MPa) | 9.0 | 8.3 | 6.9 | 7.6 | 7.5 |
| Pressure @ 551.2 MPA & Tools @ 63° C. | | | | | | |
| Green Density | (g/cm³) | 6.89 | 6.99 | 7.01 | 7.02 | 6.99 |
| Green Strength | (MPa) | 18.1 | 16.1 | 13.7 | 13.8 | 16.7 |
| Stripping Pressure | (MPa) | 15.1 | 16.2 | 15.1 | 15.7 | 15.5 |
| Sliding Pressure | (MPa) | 9.4 | 9.3 | 8.5 | 8.6 | 8.8 |
| Pressure @ 689 MPa & Tools @ 63° C. | | | | | | |
| Green Density | (g/cm³) | 6.96 | 7.08 | 7.10 | 7.11 | 7.08 |
| Green Strength | (MPa) | 17.6 | 17.0 | 14.2 | 13.8 | 16.5 |
| Stripping Pressure | (MPa) | 15.8 | 17.2 | 16.2 | 16.8 | 16.7 |
| Sliding Pressure | (MPa) | 9.8 | 10.9 | 9.9 | 10.2 | 9.7 |

The results of the compaction studies as presented in Table 4.3 demonstrate increase in compressibility for the present binders. The effects of the new binders on compressibility are best illustrated by the results of the elevated temperature studies, which show that the improvement in compressibility increase with increasing pressure. For example, at the lowest compaction pressure of 30 tsi (413 MPa), the average improvement in green density versus the proper art Mix 18 is 0.07 g/cm³, whereas at the highest pressure of 50 tsi (689 MPa), the corresponding value is 0.13 g/cm³. These improvements are contrary to normally observed cases, in which any increase in compressibility that may be due to a change in composition will be more evident at lower compaction pressures than at higher pressures. Moreover, compressibility is normally expected to decrease with increasing compaction pressures; that is, green density tends to approach its theoretical maximum asymptotically at compaction pressures above about 40 tsi (551 MPa). In these studies, what is most significant is that, for the binder-containing mixtures of this invention, the rate of increase in density with increasing compaction pressure is not leveling-off at the expected rate, at least at pressures up to 50 tsi (689 MPa).

Table 4.3 indicates that the new binders either increased the ejection forces slightly versus prior art Mix 18 or had no discernible effect. Nevertheless, it must be noted that Mix 18 contained 33% more traditional lubricant than any of the mixes of the new binders, and therefore the ejection force results for these embodiments of the new binders, are still commercially reasonable in view of the compressibility improvements which accompany use of the new binders.

What is claimed is:

1. In an improved metallurgical powder composition of the kind comprising (a) an iron-based powder, (b) a minor amount of at least one alloying powder, and (c) at least about 0.005% by weight, based on the combined widths of (a) and (b), of an organic binder for the iron-based and alloying powders, the improvement comprising that at least 40% by weight of said organic binder is a polyalkylene oxide of the general formula $$HO-(CH_2\overset{\overset{R}{|}}{C}H-O)_n-H$$

where R is H, $CH_3$, or $C_2H_5$,, and n is the average number of repeating oxyalkylene unit sufficient to provide a number average molecular weight of at least about 7,000.

2. A composition of claim 1 in which the organic binder is present in an amount up to about 1% by weight, based on the total weight of the iron-based and alloying powders, and in which the iron-based powders have an average particle size of about 150 microns or less.

3. A composition of claim 2 in which said polyalkylene oxide comprises a homopolymers or copolymer of ethylene glycol.

4. A composition of claim 2 in which said polyalkylene oxide has a number average molecular weight of about 15,000–100,000 and in which said iron-based powders have an average particle size of about 70–100 microns.

5. A metallurgical powder composition of claim 4 in which said polyalkylene oxide is a homopolymer or copolymer of ethylene glycol and wherein the composition is at least as compressible as its unbonded analog at compaction pressures up to about 700 MPa.

6. A composition of claim 5 in which the weight ratio of binder to alloying powder in the composition is in accordance with the following schedule:

| Density of Alloying Powders (g/cm³) | Weight Ratio of Binder to Alloying Powder According to Particle Size: To ~10 μm | Over 10 to ~20 μm | Over 20 μm |
|---|---|---|---|
| ≦2.5 | 0.125 | 0.125–0.175 | ≧0.175 |
| >2.5–4.5 | 0.100 | 0.100–0.125 | ≧0.125 |
| >4.5–7.0 | 0.050 | 0.050–0.075 | 0.075–0.125 |

-continued

| Density of Alloying Powders ($g/cm^3$) | Weight Ratio of Binder to Alloying Powder According to Particle Size | | |
|---|---|---|---|
| | To ~10 μm | Over 10 to ~20 μm | Over 20 μm |
| >7.0 | 0.025 | 0.025–0.050 | 0.050–0.10 |

7. A composition of claim 2 in which said polyalkylene oxide has an average molecular weight of about 15,000–35,000.

8. A composition of claim 7 in which said polyalkylene oxide constitutes at least bout 50% by weight of the organic binder.

9. A composition of claim 7 in which said polyalkylene oxide is a homopolymer or copolymer of ethylene glycol and constitutes at least about 75% by weight of the organic binder.

10. A metallurgical powder composition of claim 1 that is at least as compressible as its unbonded analog at compaction pressures up to about 700 MPa.

11. A composition of claim 1 in which the weight ratio of binder to alloying powder in the composition is in accordance with the following schedule:

| Density of Alloying Powders ($g/cm^3$) | Weight Ratio of Binder to Alloying Powder According to Particle Size | | |
|---|---|---|---|
| | To ~10 μm | Over 10 to ~20 μm | Over 20 μm |
| ≦2.5 | 0.125 | 0.125–0.175 | ≧0.175 |
| >2.5–4.5 | 0.100 | 0.100–0.125 | ≧0.125 |
| >4.5–7.0 | 0.050 | 0.050–0.075 | 0.075–0.125 |
| >7.0 | 0.025 | 0.025–0.050 | 0.050–0.10 |

12. A metallurgical powder combustion of claim 11 that is at least as compressible as its unbonded analog at compaction pressures up to about 700 MPa.

13. A composition of claim 11 in which said polyalkylene oxide has an average molecular weight of at least about 75,000 and in which said organic binder consists essentially of about 60–95% by weight of said polyalkylene oxide and about 5–40% by weight of a plasticizer for said polyalkylene oxide.

14. A composition of claim 1 in which said polyalkylene oxide has an average molecular weight of at least about 75,000, and in which said organic binder consists essentially of about 60–95% by weight of said polyalkylene oxide and about 5–40% by weight of a plasticizer for said polyalkylene oxide.

* * * * *

UNITED STATES PATENT AND TRADEMARK OFFICE

CERTIFICATE OF CORRECTION

PATENT NO. : 5,298,055

DATED : March 29, 1994

INVENTOR(S) : Frederick J. Semel and Sydney Luk

It is certified that error appears in the above-identified patent and that said Letters Patent is hereby corrected as shown below:

Column 9, line 36; "100°" should read -- 1100°--

Column 9, line 37; "150°C" should read -- 1150°C --

Column 14, line 50; "Fe:P" should read -- $FE_3P$ --

Column 17, line 25; "1.4" should read -- 11.4 --

Column 17, line 38; "2.1" should read -- 21 --

Column 17, line 43; "35,000 100,00" should read --35,000 - 100,000 --

Signed and Sealed this

Ninth Day of August, 1994

Bruce Lehman

*Attest:*

BRUCE LEHMAN

*Attesting Officer*

*Commissioner of Patents and Trademarks*